US010392188B1

(12) United States Patent
Harrison

(10) Patent No.: US 10,392,188 B1
(45) Date of Patent: Aug. 27, 2019

(54) NESTED LINER ASSEMBLY FOR A TRASH RECEPTACLE

(71) Applicant: Joe L. Harrison, Columbia, SC (US)

(72) Inventor: Joe L. Harrison, Columbia, SC (US)

( * ) Notice: Subject to any disclaimer, the term of this patent is extended or adjusted under 35 U.S.C. 154(b) by 315 days.

(21) Appl. No.: 15/421,562

(22) Filed: Feb. 1, 2017

Related U.S. Application Data

(60) Provisional application No. 62/297,321, filed on Feb. 19, 2016.

(51) Int. Cl.
*B65F 1/06* (2006.01)

(52) U.S. Cl.
CPC ..... *B65F 1/067* (2013.01); *B65F 1/068* (2013.01)

(58) Field of Classification Search
CPC ..... B65F 1/062; B65F 1/065; B65F 1/067; B65F 1/068; B65F 2001/061; B65F 1/08; B65F 1/085
See application file for complete search history.

(56) References Cited

U.S. PATENT DOCUMENTS

| | | | | |
|---|---|---|---|---|
| 3,888,406 | A | 6/1975 | Nippes | |
| 4,765,579 | A * | 8/1988 | Robbins, III | B65F 1/06 220/495.04 |
| 4,869,391 | A * | 9/1989 | Farrington | B65F 1/062 220/495.07 |
| 4,905,453 | A | 3/1990 | Siebring | |
| 4,948,268 | A | 8/1990 | Rutledge | |
| 4,978,231 | A | 12/1990 | Ling et al. | |
| 4,989,994 | A | 2/1991 | Gelbard | |
| 5,113,637 | A | 5/1992 | Gelbard | |
| 5,803,299 | A | 9/1998 | Sealy, Jr. | |
| 5,957,319 | A * | 9/1999 | Shane da Costa | B65F 1/06 220/252 |
| 6,003,717 | A | 12/1999 | Long | |
| 6,102,239 | A | 8/2000 | Wien | |
| 6,139,185 | A * | 10/2000 | Hamilton | B65D 33/14 383/11 |
| 6,808,073 | B2 | 10/2004 | Cuisinier | |
| 7,963,698 | B2 * | 6/2011 | Grazziotin | B65F 1/0006 220/495.07 |
| 8,182,564 | B2 | 5/2012 | Howard | |
| 10,293,983 | B1 * | 5/2019 | Kaplan | B65D 33/001 |
| 2002/0190069 | A1 * | 12/2002 | Cuisinier | B65D 33/001 220/495.11 |
| 2012/0291258 | A1 * | 11/2012 | Dominick | B65D 33/001 29/428 |

(Continued)

FOREIGN PATENT DOCUMENTS

| | | |
|---|---|---|
| EP | 0471670 B1 | 12/1995 |
| WO | 9010584 | 9/1990 |
| WO | 2013113053 A1 | 8/2013 |

*Primary Examiner* — Jason L Vaughan
(74) *Attorney, Agent, or Firm* — Nexsen Pruet, LLC; Michael A. Mann

(57) ABSTRACT

A nested liner assembly is a plurality of plastic trash liners, one inside the other, with tabs allowing liners to be pulled and separated, and which is held to a trash receptacle by a belt. A collar facilitates the assembling of the liners, holding the liners to the trash receptacle, and the orderly removal of the innermost liner from the remainder of the liners. Through a series of holes formed in the collar, trapped air inside the nested liners may be vented so that the assembly itself can be packaged compactly for shipment and storage.

11 Claims, 10 Drawing Sheets

(56) References Cited

U.S. PATENT DOCUMENTS

| | | | | |
|---|---|---|---|---|
| 2013/0186900 | A1* | 7/2013 | Heintzman | B65D 25/14<br>220/495.07 |
| 2017/0217676 | A1* | 8/2017 | Chenvainu | B65F 1/062 |
| 2017/0233182 | A1* | 8/2017 | Chakravarthy | B65F 1/062<br>220/495.06 |
| 2017/0233183 | A1* | 8/2017 | Chenvainu | B65F 1/062<br>220/495.06 |
| 2018/0362250 | A1* | 12/2018 | Morand | B65F 1/0006 |

* cited by examiner

NESTED LINER ASSEMBLY FOR A TRASH RECEPTACLE

TECHNOLOGY FIELD

The disclosure relates generally to plastic liners or bags for use in trash receptacles. More particularly, the disclosure relates to an assembly of plural, nested liners for sequential use with a trash receptacle.

BACKGROUND

Bags or liners made of plastic have found widespread use in facilitating the collection of refuse and trash. A liner is used to line the interior surface of a trash receptacle thereby serving as a cover for the interior surface of the receptacle to keep the receptacle cleaner and facilitate removal of the trash in it. A liner is a bag with an opening. The opening of the liner is either dimensioned to fit over the mouth of a trash receptacle or is resilient-enough to be stretched over the receptacle's mouth. When the receptacle needs to be emptied of trash, the liner with the trash inside it is removed from the receptacle, with the liner serving as a convenient interim holder for the trash. After removal, the liner may be tied or bound with a twist tie near its mouth.

Liners facilitate the gathering of trash and they help to keep the inside of a trash receptacles cleaner, and they also protect those gathering trash to collect trash from trash receptacles. The edges of the liner mouth are simply gathered together and used to lift the liner free of the receptacle, so there is usually no need to touch the trash itself or clean the receptacle. A replacement liner is then inserted into the receptacle.

Despite the use of liners, it takes time and effort to gather trash. For example, an office building may have hundreds of trash receptacles that in which the removal of the old liner and its replacement with a new one is done daily. A more efficient and productive way to collect trash from receptacles would be well-received.

SUMMARY

A nested liner assembly is a plurality of trash receptacle liners, one liner inside the other, with tabs on the liners to facilitate removal of an innermost liner from the others, leaving the remainder of the liners, including the next innermost liner, ready for use in the receptacle. A feature of the present disclosure is that, unlike the prior art, wherein a new liner has to be inserted into the trash receptacle after the previous one has been removed with its contents of trash, the present nested liner assembly already has a next liner in place. The nested liner assembly is put onto the trash receptacle and then the innermost liner is removed first, leaving the next liner for use, continuing in the same manner until the liners are filled and removed in sequence. The number of liners can be a large number depending on the thickness of the liner.

Liner thickness may be measured in mils, which are thousandths of an inch or in millimeters. A liner is thicker or thinner with respect to another liner depending on its thickness measured in either mils or millimeters.

The nested liner assembly thus reduces the effort to collect trash whenever it is used.

A collar that holds the nested liner assembly to the receptacle is a feature of the disclosure. The collar facilitates assembling the array, holding the array to the trash receptacle, and separating liners. A series of holes is formed in the collar to enable air trapped inside the nested liner assembly between the liners, the inter-liner air, to be vented so that the assembly itself can be packaged more compactly for shipment and storage.

Another feature of the nested liner assembly is the use of a more durable plastic liner, a strong liner in other words, as the outermost liner and which will hold up through the use of a plurality of liners.

Another feature of the nested liner assembly is the use of tabs on the liners to facilitate removal. The tabs are a visible and easily-grasped pair of handles for the user to grip in order to separate the top of the innermost liner from the rest of the nested liners.

Those skilled in the art of trash collection materials and methods will appreciate these and other features and their advantages from a careful review of the Detailed Description accompanied by the following drawings.

BRIEF DESCRIPTION OF THE DRAWINGS

Referring now to the drawings,

FIG. 7E showing the belt beside the nested liner assembly as the assembly is being rolled up to expel inter-liner air before the holes in the collar are taped shut, according to an aspect of the disclosure.

DETAILED DESCRIPTION

The disclosure describes a nested liner assembly and method for making it. The nested liner assembly is for use with trash receptacles and is sized for the particular receptacle it is used with.

The set of liners is a nested set of thin plastic liners. The set contains a plurality of liners. The term nested means that one liner is inside the next so that there is an innermost liner and an outermost liner with the remainder of the liners arranged between them, one inside another, running from the innermost liner to the outermost liner.

After installation of the assembly on a trash receptacle, the innermost liner is used to receive trash first. The innermost liner is the liner that is removed first. That liner is removed by pulling on its spaced-apart tabs, which enable the user to separate it from the balance of the liner assembly. After that liner is removed, the next liner immediately presents itself as the new innermost liner, ready for use. As a liner is filled with trash, it is removed, continuing to the removal of the outermost liner is removed. The outermost liner is inside a strong liner that is removed with the outermost liner from the trash receptacle to allow a nested liner assembly to be installed as a replacement on the trash receptacle.

Figure 1:
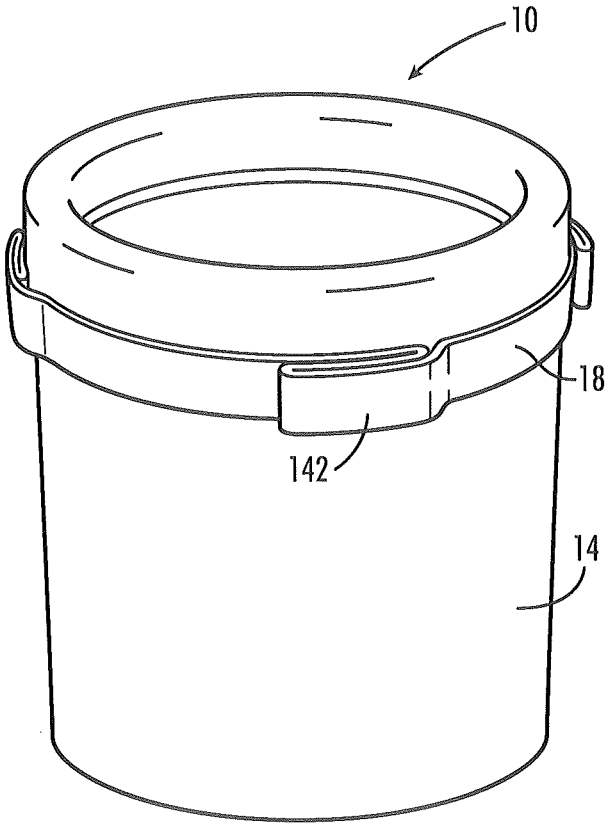
FIG. 1 is a perspective view of a nested liner assembly held to a trash receptacle by a belt, according to an aspect of the disclosure.
Figure 2:
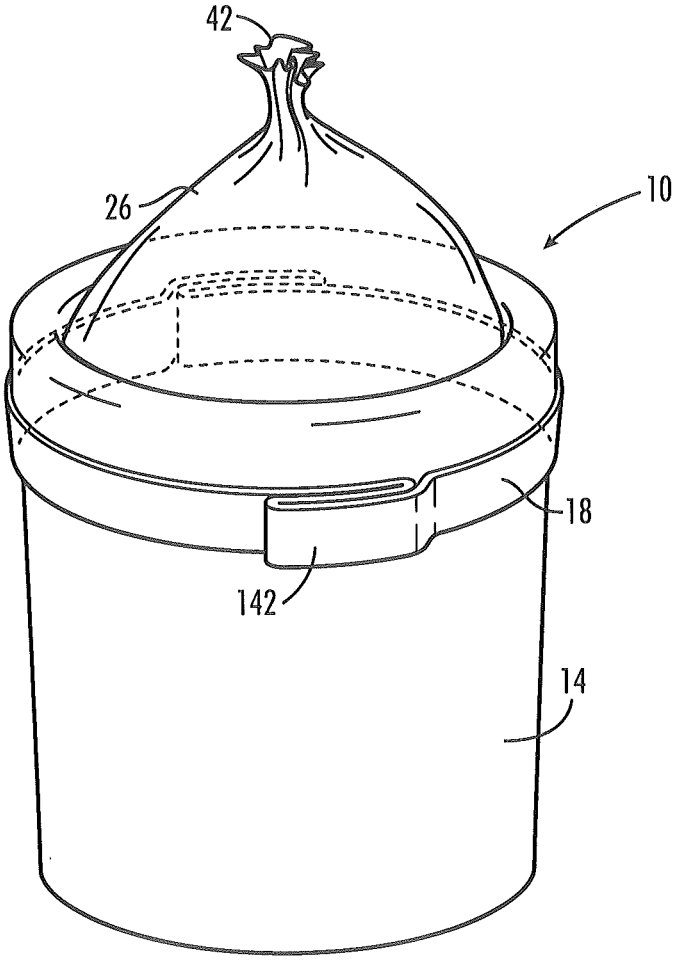
FIG. 2 is a perspective view of the nested liner assembly of FIG. 1 with the top of the innermost liner gathered for removal from the trash receptacle, according to an aspect of the disclosure.
Figure 3:
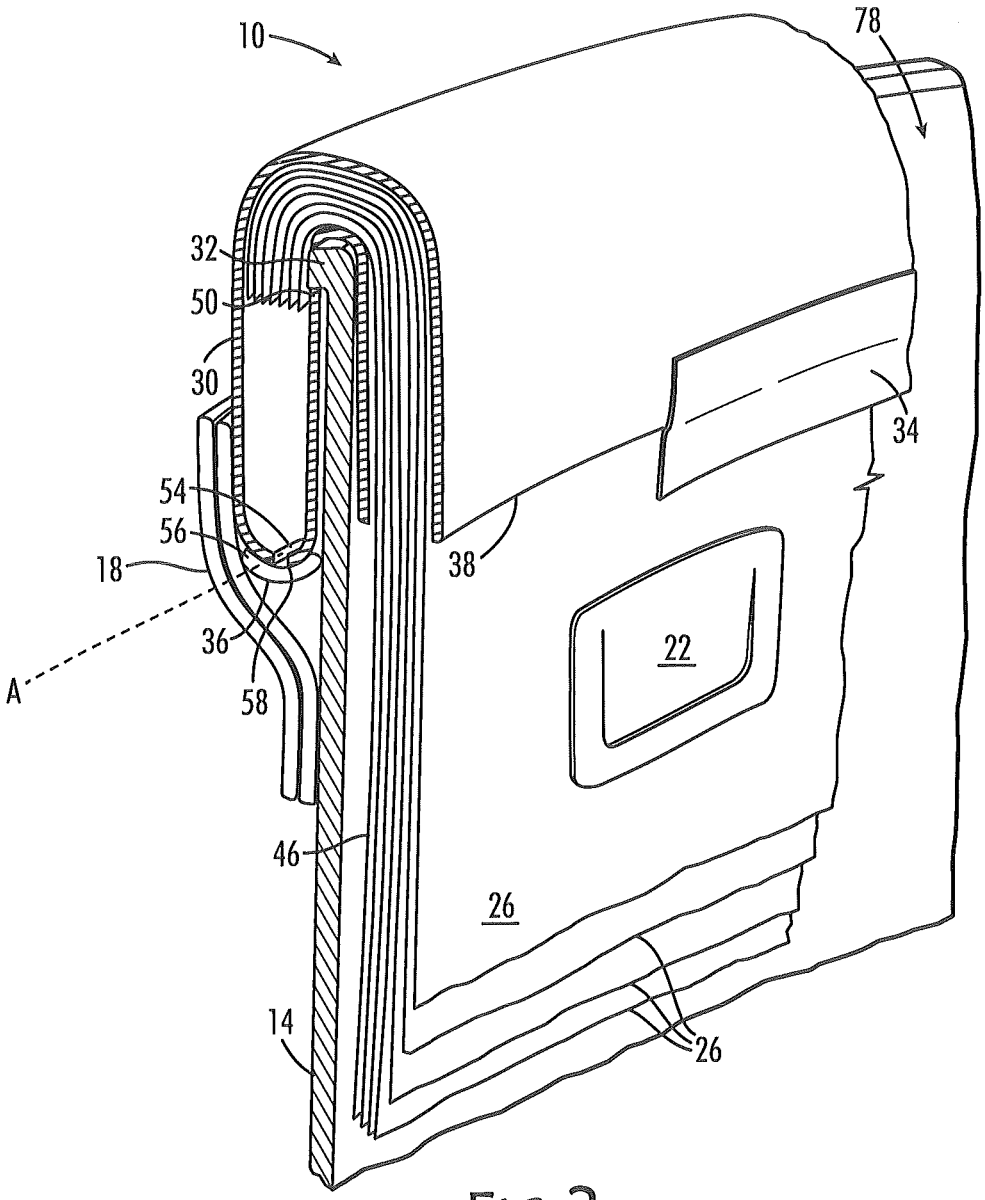
FIG. 3 shows a partial cross-sectional, perspective view of a nested liner assembly held to a trash receptacle.

Referring now to FIGS. 1-3, the disclosed article of manufacture is a nested liner assembly 10, shown in use with a trash receptacle 14. A belt 18 holds nested liner assembly 10 to trash receptacle 14, which means that nested liner assembly 10 is held to trash receptacle 14 so that nested liner assembly 10 is not easily removed from receptacle when trash is being placed into receptacle or a liner of assembly 10 is being removed. Two spaced apart tabs 22 (shown in FIG. 3) on the inside surface of liner 26 facilitate removal of liner 26 from the balance of nested liner assembly 10. The tops of liners 26 are captured by fold 36 in a collar 30 that is flexible and, in use, extends around a rim 32 of trash receptacle 14, extending inside and outside of rim 32 into the interior and down the outside of the exterior of trash receptacle 14. Collar 30 has a major axis A. A fold 36 is formed in collar 30 parallel to major axis A. Tape 34 is applied to the edge 38 of collar 30 to hold it to liner 26. Tape 34 is removed when nested liner assembly 10 is in position on trash receptacle 14, and then liner 26 can be removed by pulling tabs 22 together and up, gathering the mouth 42 (FIG. 2) of liner 26, which may be closed against spilling its contents by knotting it, using twist ties or, other convenient closure.

When the last of liners 26 have been filled with trash and removed from nested liner assembly 10, belt 18 is loosened where it overlaps itself (as seen in FIGS. 1 and 2) and may be placed into a strong liner 46, which is a thicker plastic bag than liner 26 or one made of a stronger material even if it is about the same thickness or thinner, and then strong liner 46 with collar 30 and belt 18 are discarded, thereby making way for a nested liner assembly 10 to be installed onto trash receptacle 14.

FIG. 3 illustrates additional detail of collar 30. Collar 30 has a mid-axis A that follows the perimeter of nested liner assembly 10 and is between edge 38 and an edge 50. Along mid-axis A of collar 30 at intervals are holes 54. Holes 54 are vents for expelling inter-liner trapped air for better nesting of liners 26. After trapped air is expelled from between liners 26 through holes 54, tape 56 is applied over the holes 54, liners 26 to prevent air from rushing back in and thereby will keep nested liner assembly more compact for packaging.

Figure 4A:
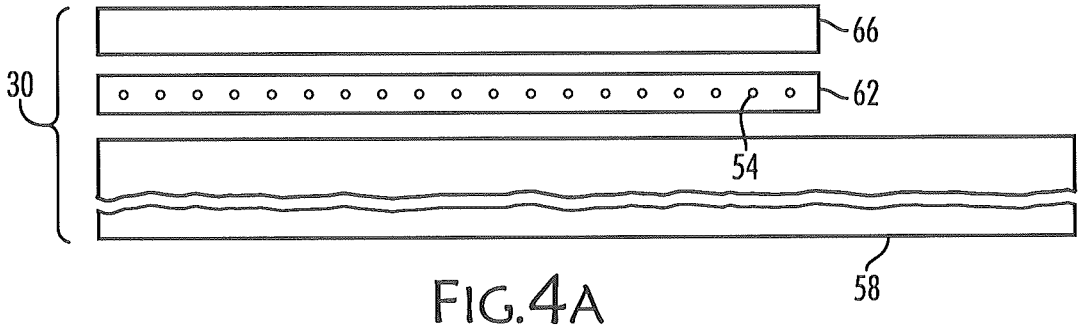
FIGS. 4A and 4B, show an exploded view of the collar and an assembled view of the collar, respectively, according to an aspect of the disclosure.
Figure 4B:
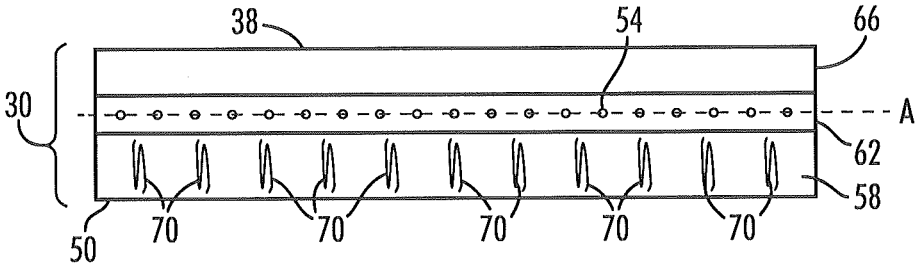

Collar 30, as seen in an exploded, pre-assembled view in FIG. 4A, is comprised of an outer band 58, a central band 62, and an inner band 66. Outer band 58 is longer than central band 62 and inner band 66, as measured by their major dimensions; central band 62 and inner band 66 are the same length. Outer band 58, central band 62, and inner band 66 may be made of a material that stretches and is not brittle, and has significant physical memory so that it returns to its manufactured dimensions after being stretched and released. Outer band 58, central band 62, and inner band 66 are longer than they are wide, even when they are combined with their long dimensions parallel, as seen in FIG. 4B. Their length when joined is at least as long as the circumference of the receptacle 14 with which they will be used. Mid-axis A parallel runs through central band 62 parallel to its long dimension. Holes 54 are thus formed in central band 62.

Outer band 58, which has a longer long dimension when compared to the long dimension of inner band 66, is shortened so that its shortened long dimension is the same length as that of central band 62 and inner band 66, Shortening outer band 58 is accomplished by the formation of a series of pleats 70 in outer band 58. Pleats 70 also enable outer band 58 to be bent over the rim 32 easily. After outer band 58 is pleated, it is joined to central band 62 and to inner band 66. Outer band 58, central band 62, which is joined to inner band 66. Outer, central and inner bands 58, 62, and 66 may be joined in any convenient way, such as tape, adhesives, sewing, or heat welding, for example.

After collar 30 is assembled from the combination of outer band 58, central band 62, and inner band 66, it is attached to the mouth 78 of strong liner 46 so that edge 38 overlaps mouth 78 of strong liner 46. Mouth 78 of strong liner 46 may overlap inner band 66 and does not cover holes 54 and does not overlap outer band 58. Collar 30 is attached to strong liner 46 using tape 82. Alternatively, an adhesive or heat seal may be used to attach strong liner 46 to collar 30.

Figure 5A:
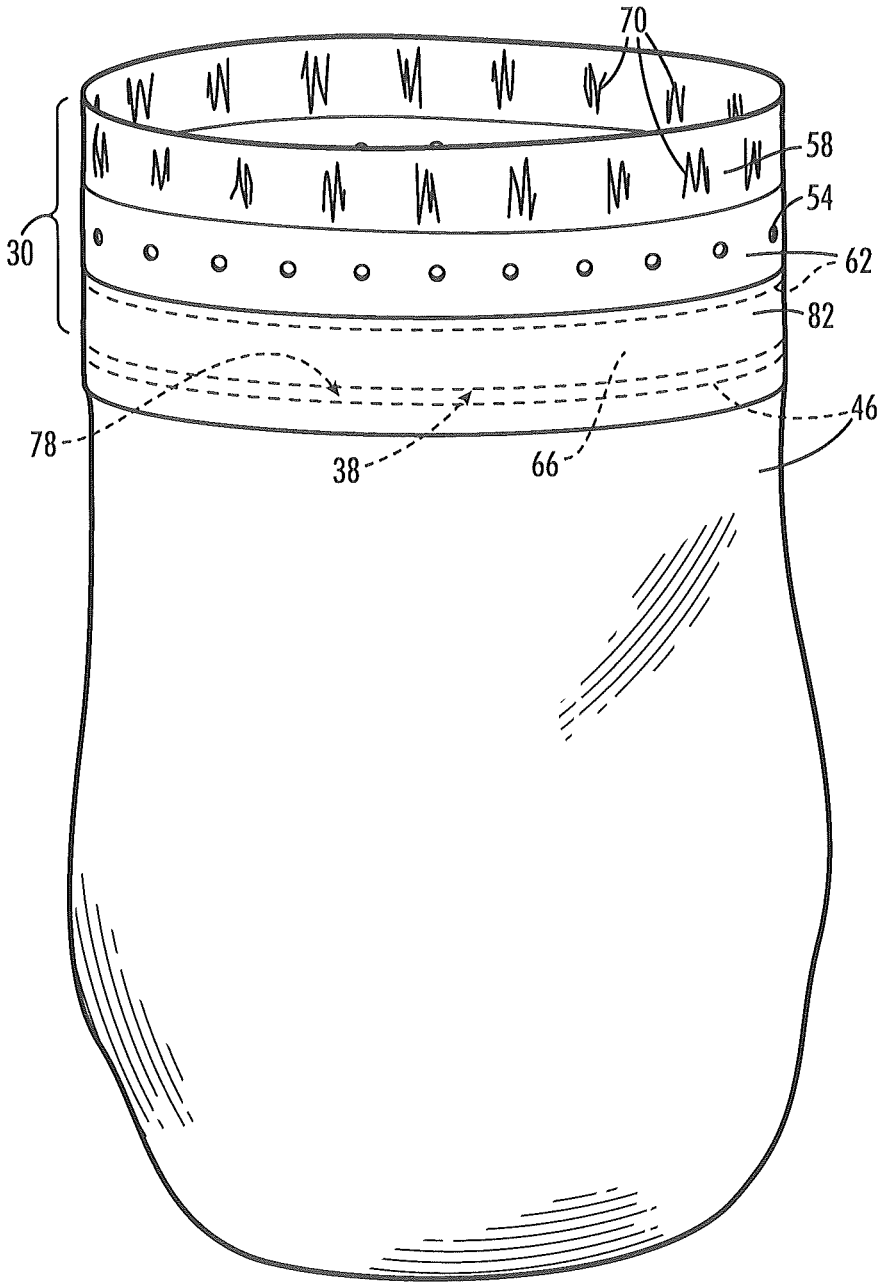
FIGS. 5A and 5B show a perspective view of the assembled strong liner and collar, and the inverted strong liner with the collar folded to form a trough to receive the nested liners, respectively, according to an aspect of the disclosure.
Figure 5B:
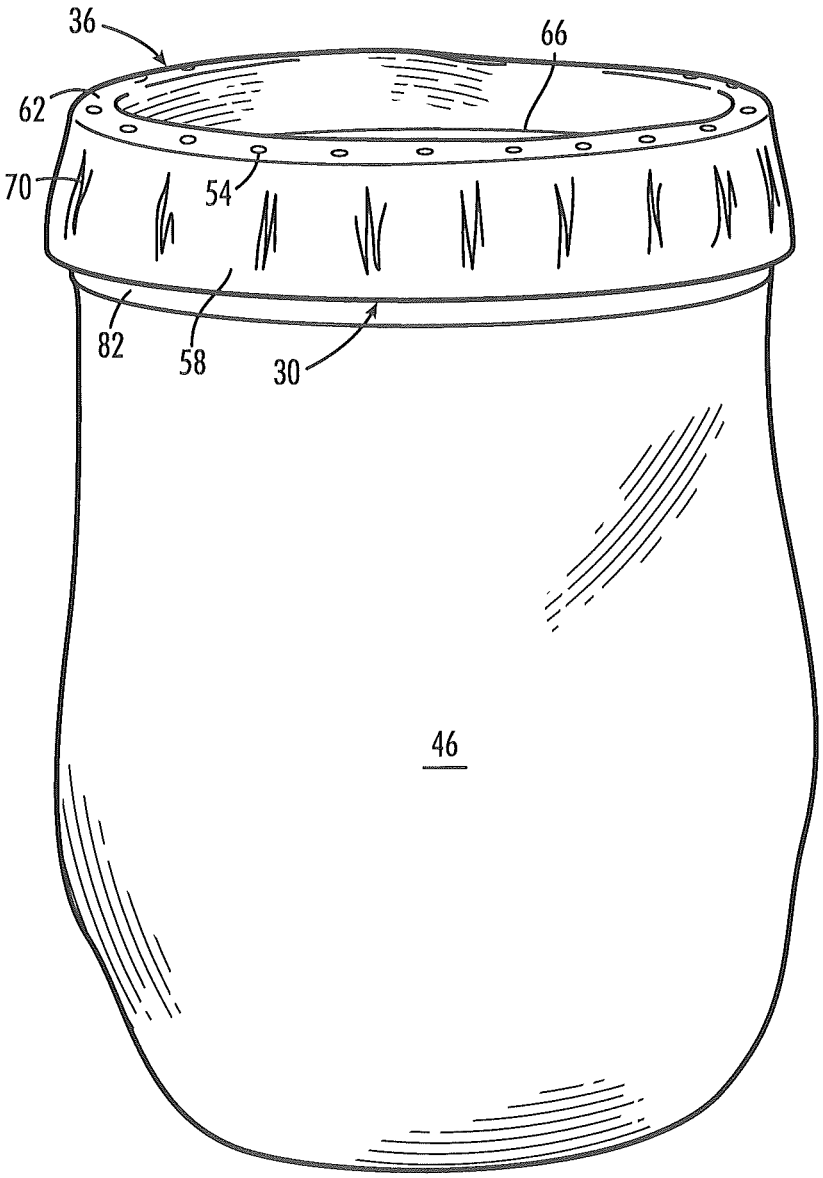

At this point in construction, strong liner is inverted, as shown is FIG. 5B, and outer band 58 inverted with it, while fold 36 is formed in central band 62 along mid-axis A so that holes 54 are at the end of fold 36 and a trough 86 formed from outer band 58 encircling mouth 78 of strong liner 46, as seen in FIG. 4C.

Figure 6A:
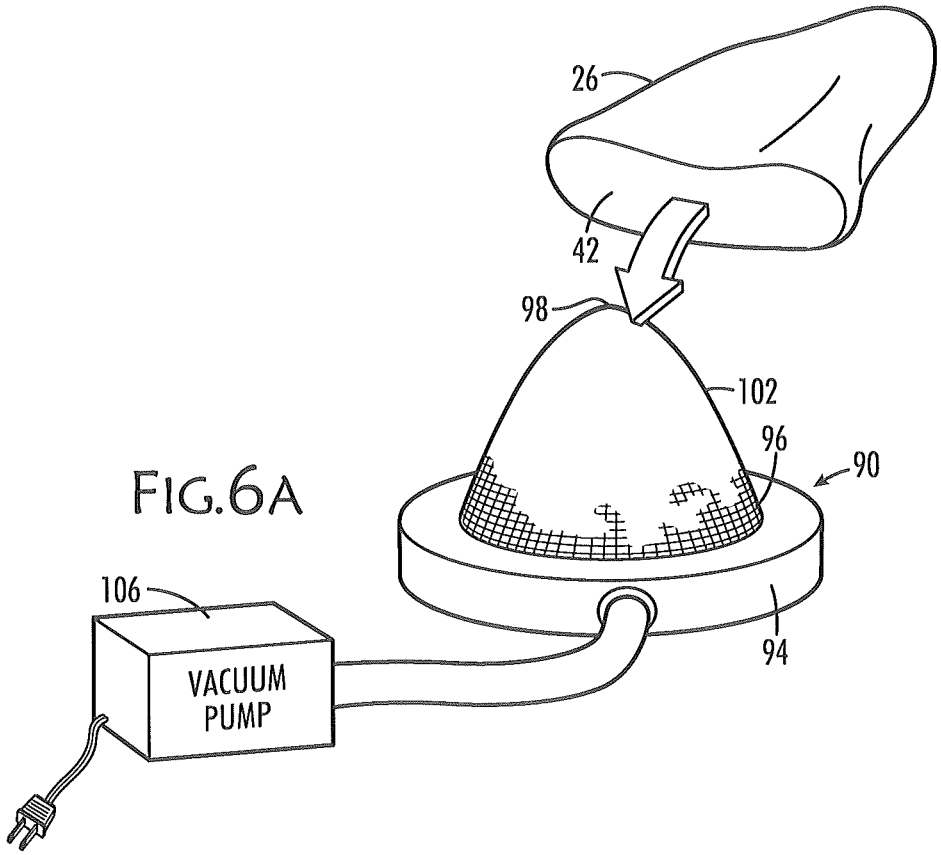
FIGS. 6A, 6B, and 6C show a first mandrel for removing air from inside a liner, with FIG. A showing the liner about to be placed on the first mandrel, FIG. B showing the air being removed from the liner while on the first mandrel, and FIG. C showing the evacuated liner being pulled from the first mandrel so that air does not refill the liner, according to an aspect of the disclosure.
Figure 6B:
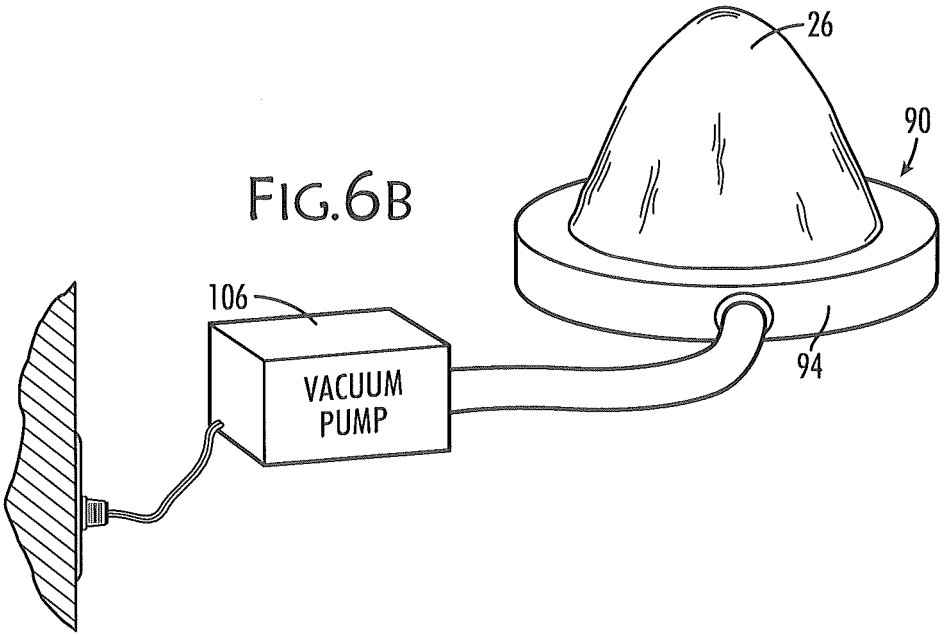
Figure 6C:
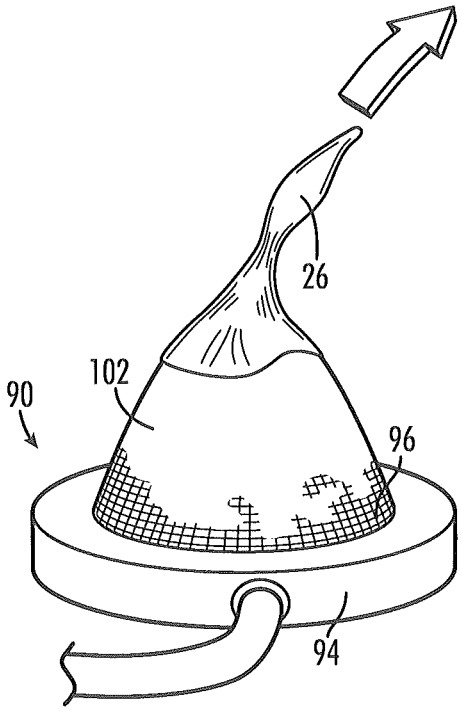

To nest a series of liners 26, a first mandrel 90 with a base 94 is provided. First mandrel 90 has a bottom 96 having the same size as mouth 42 of liner 26, a smaller top 98, and a side 102 made of mesh. First mandrel 90 is connected to a vacuum pump 106 to draw air through side 102 from outside first mandrel 90, as shown in FIGS. 6A, 6B, and 6C Then one by one, liners 26 are placed over first mandrel 90 so that air can be drawn from their interior by vacuum pump 106. Liner 26 is removed from top 98, so that it is long, has a small effective diameter and is shrunken in appearance, is seen in FIG. 6C.

Figure 7A:
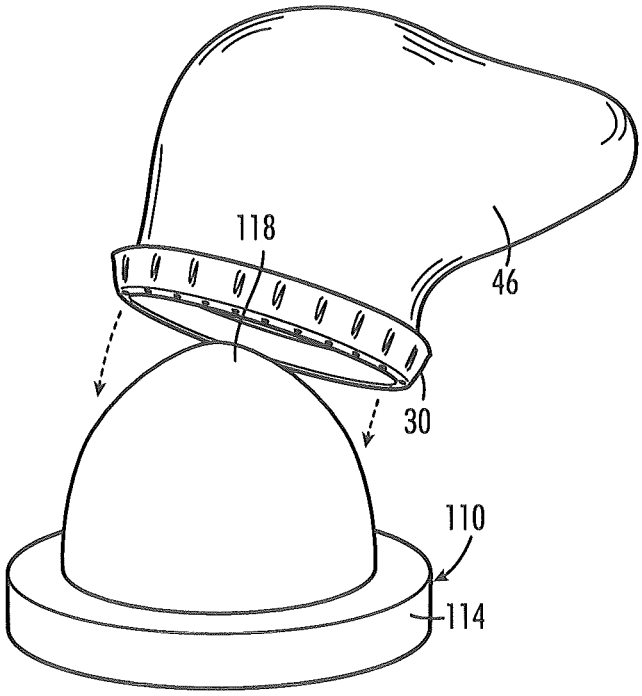
FIG. 7A-7E illustrate how the nested liner assembly is completed, with FIG. 7A showing the strong liner and collar being placed on a second mandrel, FIG. 2 showing a liner being placed over the strong liner and its mouth being tucked into the trough formed by the folded collar, FIG. 7C showing a liner on the strong liner which is partially cut away to show the plurality of nested liners, FIG. 7D showing the collar folded against the strong liner and taped.
Figure 7B:
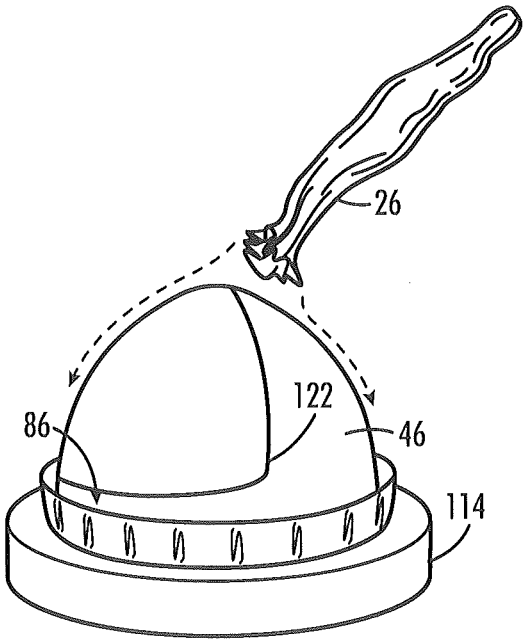
Figure 7C:
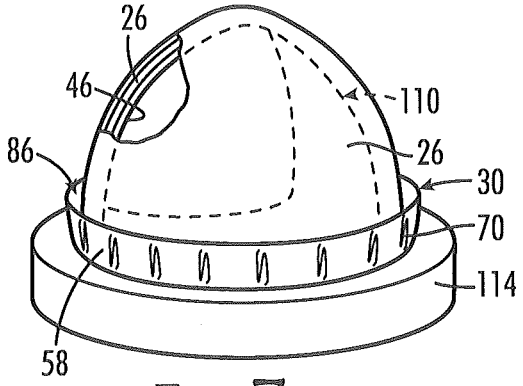
Figure 7D:
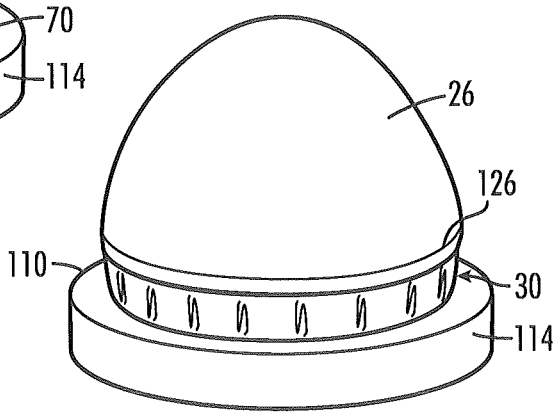
Figure 7E:
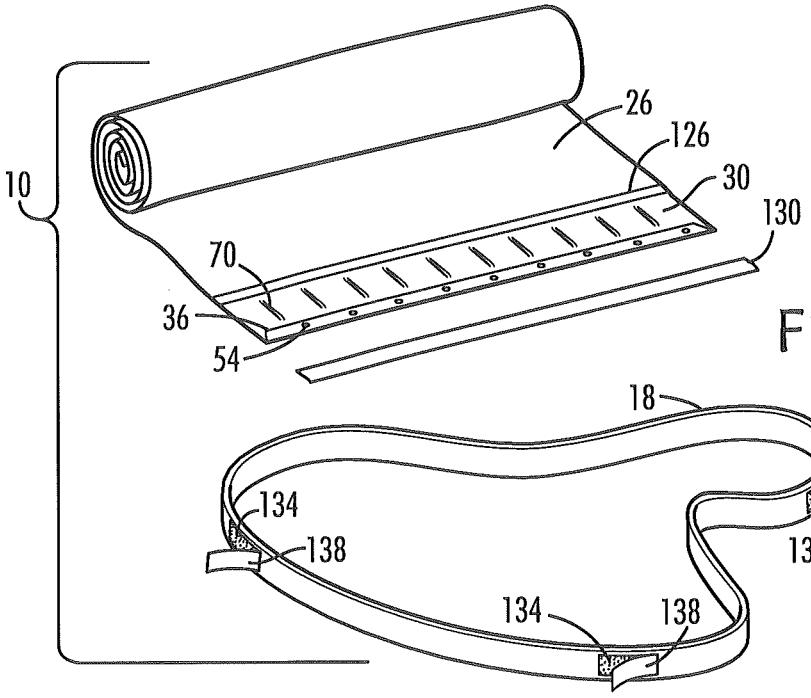

FIGS. 7A-7E show the final assembly steps for nested liner assembly 10. As best seen in FIG. 7A a second mandrel 110 is provided with a base 114 and a pointed top 118. Strong liner 46 with collar 30 attached is pulled over second mandrel 110, collar 30-side down. In FIG. 7B, a corner of strong liner 46 is pulled tight and folded to form a flap 122 against the balance of strong liner 46. One by one, as seen in FIG. 7B, liners 26, which have been largely evacuated of air in the steps shown in FIGS. 6A-6C, are pulled over second mandrel 110, and a liner 26 next pulled on top of a liner 26 already in position until the total number of liners 26 reaches a predesignated number. FIG. 7C is partially cut away to show the stack of nested liners.

A nested series of liners 26 are tucked into trough 86, and outer band 58 is then folded against the balance of collar 30 and attached, for example, held to liners 26 as a unit by using tape 126 as shown or by using adhesives.

The number of liners 26 may be any convenient number selected with a view to the type of trash, liner thickness, and frequency of trash collection. For example, there may be at least 20 liners nested in one nested liner assembly 10. Twenty-five liners may be a one-month supply for use in an office building trash receptacle. A larger number, such as 50 or 75, may be advantageous because it reduces the number of times in a year a nested liner assembly 10 may be used per receptacle.

The almost-completed nested liner assembly 10 is then rolled or pressed to expel any remaining air from the inter-liner spaces through holes 54. A strip of tape 130 is then applied over holes 54 to prevent air from re-infiltrating nested liner assembly. Nested liner assembly 10 is then ready to be installed on a trash receptacle 14.

To install nested liner assembly 10 onto a trash receptacle 14 as seen in FIG. 1, Belt 18 is folded so that release paper 138 is just after the half way part of the fold. Belt 18 may be a continuous loop with a patch 134 of adhesive along one side and a release paper 138 on top of the patch. The release paper 138 may then be removed and the patch 134 pressed against the belt 18 to hold a bite 142, that is, a fold or loop, in belt 18, to reduce the effective circumference of belt 18 to match the circumference of trash receptacle 14. Belt 18 will be sized to be somewhat larger than the trash receptacle for which it is intended.

Those skilled in the art of trash liner collection will appreciate various modification and substitutions may be made to the foregoing description of aspects of the disclosure that fall within the spirit and scope of the claims that follow.

What is claimed is:

1. A method for making a nested liner assembly, said method comprising the steps of:

providing a collar having a major axis;

forming a plurality of holes formed in said collar;

forming a fold in said collar parallel to said major axis;

attaching said collar to a strong liner, said strong liner having a mouth and wherein said collar extends beyond said mouth of said strong liner;

inverting said strong liner so that said collar forms a trough with said fold in said trough;

placing a first liner onto over said strong liner;

placing a second liner over said first liner so that said first and second liners are nested liners;

tucking said first and second nested liners into said trough of said collar;

attaching said collar to said nested liners; and inverting said nested liners so that said nested liners are inside said strong liner.

2. The method of claim 1, further comprising the steps of;

providing a first mandrel; and placing said strong liner with said collar on said first mandrel.

3. The method of claim 1, wherein said collar is made by the process comprising the steps of:

providing a central band of material and an outer band of material, said outer band being longer than said central band;

pleating said outer band to have the same length as said central band of material; and attaching said central band to said outer band.

4. The method of claim 3, further comprising the steps of:

proving an inner band of material; and attaching said inner band to said central band to form said collar.

5. The method of claim 1, further comprising the step of providing a belt for use with said liners on a trash receptacle having a perimeter, said belt dimensioned for fitting on said perimeter of said trash receptacle.

6. The method of claim 5, further comprising the steps of forming a belt of material having a circumference larger than a perimeter of a trash receptacle, said belt having an outer surface;

applying a patch of adhesive to said outer surface of said belt; and applying a release paper over said patch of adhesive.

7. The method of claim 1, wherein said method further comprises the steps of:

providing a second mandrel wherein said mandrel has holes formed therein in;

drawing air through said holes in said mandrel as said first and said second liner are placed over said second mandrel; and removing said first and said second liners from said second mandrel before placing said first and second liners on said strong liner.

8. The method of claim 1, further comprising the step of rolling said nested liners toward said collar to expel any inter-liner air through said plurality of holes of said collar after said inverting step.

9. The method of claim 1, further comprising the steps of:

placing said first liner on a second mandrel;

drawing air out of said first liner through said second mandrel;

pulling said first liner from said second mandrel to place on said strong liner;

placing said second liner on said second mandrel;

drawing air out of said second liner through said second mandrel; and pulling said second liner from said second mandrel to place over said first liner on said first mandrel.

10. The method of claim 9, wherein said collar is made by the process comprising the steps of:

providing a central band of material, an outer band of material, and an inner band of material, said outer band being longer than said central band;

pleating said outer band to have the same length as said central band of material;

attaching said central band to said outer band; and attaching said inner band to said central band.

11. The method of claim 10, further comprising the steps of forming a belt of material having a circumference larger than a perimeter of a trash receptacle, said belt having an outer surface;

applying a patch of adhesive to said outer surface of said belt; and applying a release paper over said patch of adhesive.

* * * * *